United States Patent [19]

Bick et al.

[11] 4,048,043

[45] Sept. 13, 1977

[54] SELECTIVE PLATING APPARATUS

[75] Inventors: Maurice Bick, South Orange; Richard J. DiMurro, Harrison, both of N.J.

[73] Assignee: Auric Corporation, Newark, N.J.

[21] Appl. No.: 655,880

[22] Filed: Feb. 6, 1976

[51] Int. Cl.[2] ..... C25D 17/28; C25D 5/02

[52] U.S. Cl. ..... 204/224 R; 204/202; 204/DIG. 7

[58] Field of Search ..... 204/15, 231, DIG. 7, 204/202, 198, 224 R

[56] References Cited

U.S. PATENT DOCUMENTS

| | | | |
|---|---|---|---|
| 2,044,415 | 6/1936 | Yates | 204/DIG. 7 |
| 2,044,431 | 6/1936 | Harrison | 204/DIG. 7 |
| 3,880,725 | 4/1975 | Van Raalte | 204/DIG. 7 |
| 3,951,772 | 4/1976 | Bick et al. | 204/202 |
| 3,966,581 | 6/1976 | Holte | 204/202 |

*Primary Examiner*—T. M. Tufariello
*Attorney, Agent, or Firm*—Stefan J. Klauber

[57] ABSTRACT

Apparatus and method for continuous electroplating of at least first and second selected portions of an electronic component or the like, while effecting differential plating thicknesses upon said portions. The apparatus includes means for moving the components through an electroplating station with the portions selected to be plated in contact with a moving applicator belt. Means are provided for shunting a portion of the plating current preceding toward at least one of the selected portions of the component, back to the source which enables the plating potential, whereby differential plating is effected between the first and second portions of the component.

6 Claims, 4 Drawing Figures

SELECTIVE PLATING APPARATUS

BACKGROUND OF INVENTION

This invention relates generally to electroplating apparatus and methodology, and more specifically relates to the electroplating with gold of electronic components or the like.

Gold, within recent years, has become a very important part of the electronics industry. Among those properties recommending its use therein, are its relative unalterability, high solderability and low contact resistance. In the semi-conductor field, gold has furthermore found favor because of its ability to readily form an eutectic alloy with silicon and germanium. In the latter connection it may be noted that most headers or packages for diodes, transistors, and integrated circuits are gold plated as a preparation for the mounting or attaching of semi-conductor devices. Such components are exemplified by the well-known line of TO-5 and TO-8 multi-lead headers. Such headers consist of an eyelet of Kovar metal to which several insulated Kovar leads are attached, and sealed in glass.

In accordance with known principles in the art, headers of the foregoing type have, in the past, been plated (among other methods) by so-called barrel plating techniques — that is, by subjecting such articles to electroplating while a plurality of articles tumble in a barrel. These barrel techniques, however, have many important drawbacks, numerous of which are recognized in the art. For example, where headers or the like are thus plated, it is found that many leads do not make electrical contact with the remainder of the load. Where such conditions obtain during the plating cycle, the portion of the lead closest to the anode becomes cathodic. Such leads become bipolar, and at the anodic portion of the leads problems can arise in that the gold may redissolve anodically, and as well base metal can be attacked to expose bare spots. Where the tumbling action is markedly inadequate these problems can become quite severe. In the past these problems have partially been overcome by incorporating mechanical means for improving electrical conductivity through the load. Such means have taken the form of metal particles or metal shot. Unfortunately during plating operations the shot itself becomes gold plated, resulting in the loss of gold and attendant increase in the cost of plating the desired objects, that is, the headers, etc.

Within recent years, particularly because of the soaring price of gold, it has furthermore been increasingly appreciated that barrel plating techniques (and as well, common rack plating techniques) are exceedingly wasteful of the gold itself. If one considers, for example, the most common use of barrel plating in the electronic industry, i.e. the plating of the aforementioned headers, it will be appreciated that basically one is only interested in providing a plating at the die-receiving face thereof, and at the contact connections for the header leads which are present at the said face. Barrel plating techniques, however, are such that the entire header is plated with gold — including all electrically conductive, accessible portions thereof. Furthermore, since barrel plating is based upon the development of multiple electrical contacts among the tumbling components, it is basically a statistical process, this is to say that different components in a tumbled load may be subjected to markedly different plating times. In order to achieve a desired mean plating thickness, it is therefore necessary to grossly overplate. In order to assure that all of the individual components in the batch receive adequate plating, it is frequently necessary to overplate many of the components by as much as 10% to 20%. This is obviously a further waste of the precious gold material.

In U.S. Pat. No. 3,904,489 to Frank J. Johnson, which patent is assigned to the same assignee as is the instant application, apparatus and methods are disclosed which are highly effective in overcoming the foregoing problems. In such Johnson apparatus the components to be selectively plated are conveyed across the surface of a moving electroplating applicator with the portions selected to be plated in contact with the electroplating solution. A DC electrical potential is applied between the portions of the components which are to be plated and the back of the applicator surface, to enable the electroplating action.

It may be noted in the foregoing connection, that a peculiar and specific problem that is present where components of the type discussed are subjected to the described selective electroplating operations, arises because the components are possessed of not only a relatively flat die-receiving face, but the face as mentioned, is provided with a plurality of electrical contacts which are insulated from the remainder of the face, and are electrically accessible (during plating) primarily from wire like leads which extend oppositely from the face. The peculiar problem that is thus presented, is that a potential must be applied not only to the body of the component, i.e. so that the die-receiving face may be suitably electrified, but moreover a potential must be enabled to each of the insulated contacts — if one desires to plate same.

Improvements upon the aforementioned Johnson apparatus are disclosed in a copending application of Maurice Bick et al, Ser. No. 472,952, filed May 31, 1974, and entitled "Selective Plating Apparatus", this application also being assigned to the assignee of the present application. In the cited application the improved apparatus is characterized by an arrangement wherein the conveyor belt for the components passes through a channel in a stationary guide means at the electroplating station, which guide means accurately spaces the components with respect to the applicator, and restrains the components from undesired wobble or vertical movements. The leads of the components, as mentioned, are connected to the electrically isolated terminals or contacts on the die-receiving face of the components, and such leads protrude from the guide as they progress through the channel therein. Electrical contact with the leads, for purposes of plating the isolated contacts, is made by a flexible conductor — which may be a brush or similar conductive surface, which can be maintained stationary as the components are swept past same with the leads in contact with the surface.

It has been found in use of the various aforementioned selective plating apparatus that the plating quality achieved on the isolated contacts, particularly vis-a-vis the plating at the die-receiving face, can exhibit unacceptable aspects. A component emerging from such prior art type device may thus appear perfectly satisfactory to the observer; but upon being subjected to the standard bake-out tests utilized in the semi-conductor industry, the die-receiving face may exhibit satisfactory plating, while the contacts are unacceptably plated — in that cracking or so forth may occur. In order to render the plating completely satisfactory in all respects, it has been thought that the overall plating must be increased to a point whereat relatively high thicknesses are provided for the contacts. This in turn is wasteful of the gold, in that unnecessary and inordinate amounts are plated upon the die-receiving faces.

SUMMARY OF INVENTION

Now in accordance with the present invention, it has unexpectedly been found that by incorporating a shunt path in parallel with the anode circuit (in apparatus of the foregoing type), which path acts to shunt at least part of the current from those portions of the plating circuit which include the component body, differential plating may be provided as between the die-receiving face of said components on the one hand, and the insulated contacts on the other. The differential in plating may be accurately controlled by the inclusion of means for selectively varying the resistnce in the shunt path as, for example, by utilizing a controllable variable resistance. While the differential in plating thus achieved, provides in one aspect of the invention a simple difference in plating thickness; it has further been discovered, that qualitative improvements are secured in the plating on the contact leads. By the latter is meant that superior plating qualities are achieved for both contacts and the die-receiving face — vis-a-vis equal plating thicknesses secured where a common current level is utilized to both the body and lead portions of the component, i.e. in accordance with prior art procedures and apparatus.

While the improvement enabled by the invention is particularly applicable, as indicated, to apparatus utilized in connection with selective plating of the aforementioned headers or the like, the techniques are also employable in other environments wherein at least first and second mutually insulated selected portions of components or the like are to be plated — as to effect differential plating thicknesses between such portions.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
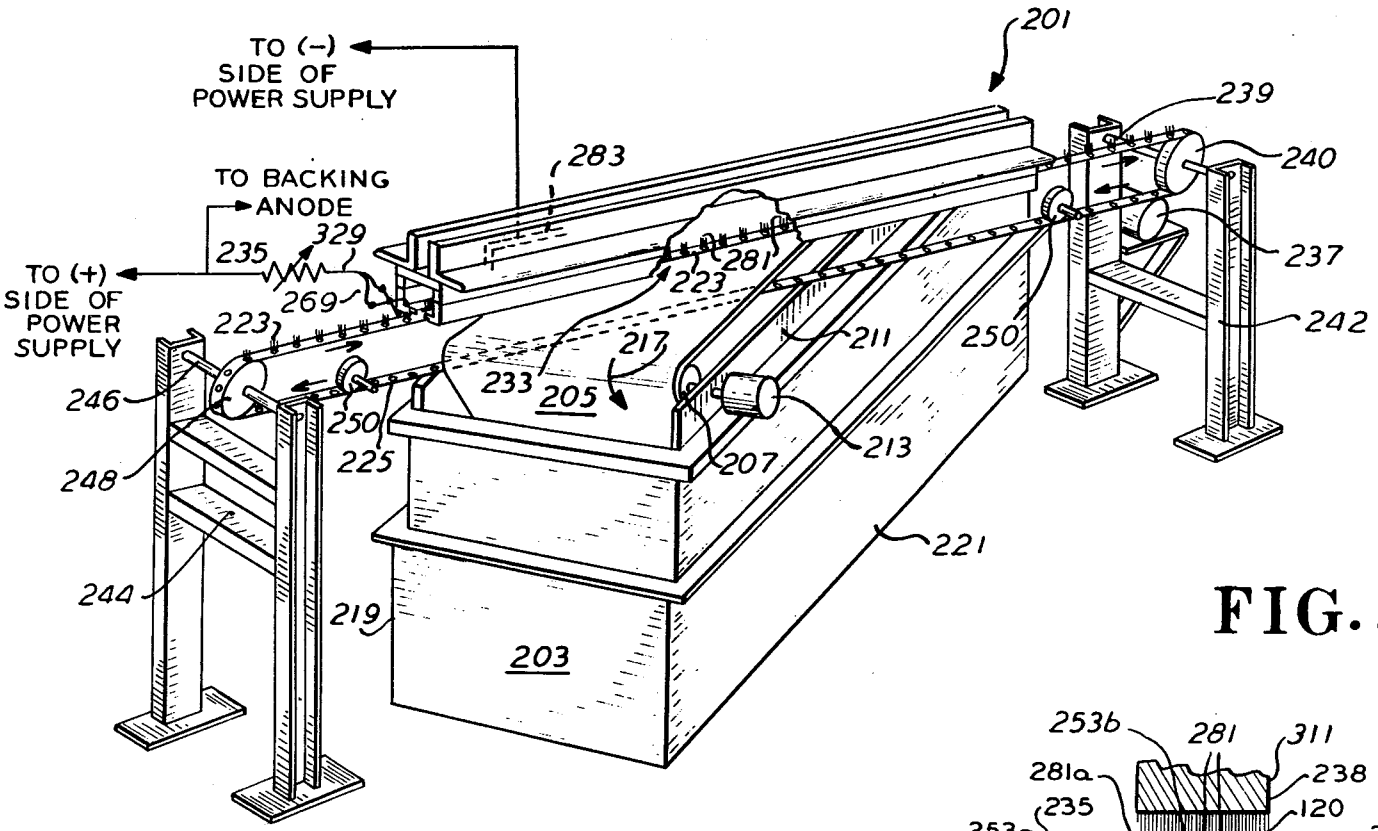
FIG. 1 is a perspective view of a preferred form of selective electroplating apparatus in accordance with the invention.

In FIG. 1 a perspective view appears of selective electroplating apparatus 201 in accordance with the principles of the present invention. The mechanical aspects of the present device are in general similar to apparatus disclosed in the patent application of Maurice Bick et al, Ser. No. 474,952, filed May 31, 1974, and assigned to the same assignee as is the present application.

Figure 3:
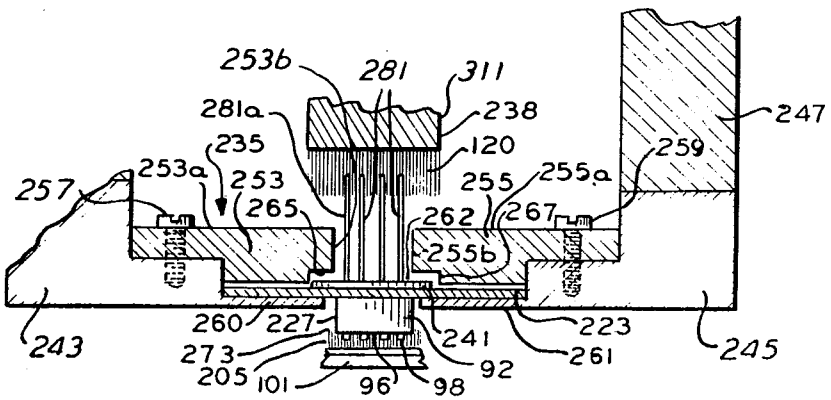
FIG. 3 is a cross-sectional view through the elements of FIG. 2; the view is taken along the line 3—3' of FIG. 2, and also shows the underlying anode and the plating solution applicator belt.
Figure 2:
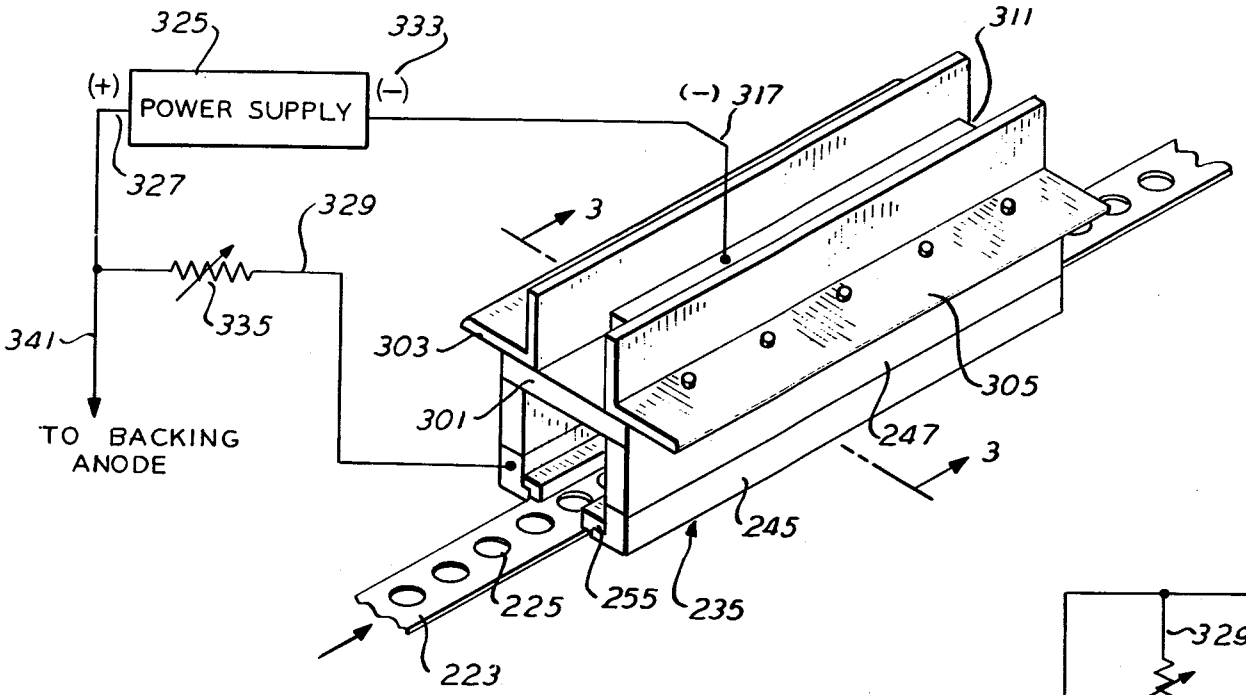
FIG. 2 is an enlarged perspective view of a portion of the FIG. 1 apparatus, and illustrates the guide and brush elements and the electrical connections thereto.
Figure 4:
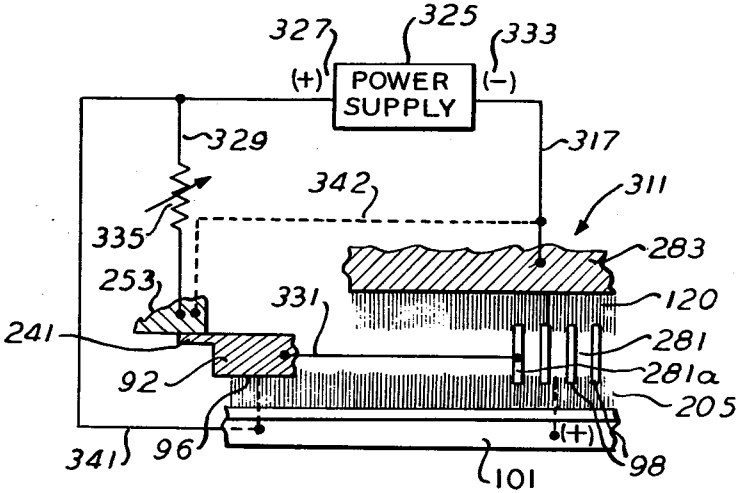
FIG. 4 is a schematic diagram illustrating the equivalent electrical circuit provided by the invention in the course of plating a typical component.

In considering FIG. 1, cross reference may usefully be had to the enlarged perspective view of FIG. 2, to the cross-sectional view of FIG. 3, and to the schematic diagram of FIG. 4. From these latter views the nature of the electrical connections, and thereby of the principles of the invention, will be further apparent. Similar elements are identified by corresponding reference numbers in the several Figures.

Apparatus 201 thus includes a reservoir tank 203 for electroplating solution which is carried therein. Since apparatus 201, as has been previously indicated, is of particular use in gold electroplating applications, the electroplating solution (although not per se comprising part of the present invention), commonly comprises an aqueous solution of an alkali-gold-cyanide, together with suitable buffering compounds, conductivity salts, and other agents as may be known in this art to be useful in promoting the production of high quality gold platings.

An electroplating solution applicator belt 205 is mounted about a plurality of rollers, one of which is seen at 207. The rollers may e.g. be three in number, as for example, is illustrated in the aforementioned Bick et al applications. The rollers may be journaled for rotation as, for example, by being mounted on axes supported by tank frame members 211; and one or more motive elements, as for example, the electric motor 213, may be provided for enabling continuous movement of the applicator belt through the plating solution and past the components being plated. It will thus be understood that the lower portions of the applicator belt pass through the electroplating solution contained within tank 203, and thus the said belt is continuously wetted by the solution. Although not shown, in order to simplify the present Figure, a duct may also be provided for distributing additional electroplating solution at the portions of the belt progressing toward electroplating station 233. This duct may take the form of a tubular header provided with multiple openings, which header can extend the width of the belt, parallel to but slightly spaced from the belt and roller, and continuously distribute the plating solution in sprinkling fashion. The header is provided with its supply of electroplating solution by means of a pump positioned at the bottom of tank 203, which pump serves the additional purpose of continuously agitating the electroplating solution. An electric, or other energized heater, is also commonly present in the tank for maintaining the electroplating solution at a desired temperature level. All of the foregoing aspects of the invention are further discussed in the cited Bick et al application.

It will be noted that belt 205, is oriented at the same direction as the walls of tank 203. In accordance with the arrangement in the aforementioned Bick et al application, the components to be treated by apparatus 201 are passed in array across applicator belt 205, at a skewed direction with respect to the direction 217 of advance of the applicator belt. The skewing is thus achieved by angling the direction of advance of the components with respect to the lateral walls 219 and 221 of tank 203. By virtue of this arrangement, and the relative speed of advance of the components and applicator belt, each component (in the course of its advance) continuously encounters fresh plating solution.

The conveying means in the apparatus 201 comprises a conveying belt 223, which is formed as a closed loop. Belt 223, as seen both from FIG. 2 and the partially sectional view of FIG. 3, includes a series of circular openings 225, which are adapted to hold components 227, inserted into such openings at the region before belt 223 reaches plating station 233. The components may be thus loaded by known devices, including inclined tracks, or manual loading is possible. Belt 223 may comprise a stainless steel or similar material. Since, as will be further discussed in connection with FIGS. 2 and 3, belt 223 progresses through a guide 235 in which it is slidingly received, the belt 223 is preferably coated with a material such as teflon to provide a self-lubricating face for the belt where it contacts the adjacent faces of guide 235. This also renders the belt 223 electrically insulated from the components 227. Motive power enabling progression of belt 223 is provided by an electric motor 237, which connects through a belt and pulley arrangement to the drive shaft 239 for guide roller 240. Drive shaft 239 is journaled in a support frame 242. A second support frame 244 at the opposite end of apparatus 102 journals a shaft 246 for an idling roller 248. Guides and tension take-up rollers are also provided at 250.

A component 227 (FIG. 3), nests in the opening 225 so that the lip or rim 241 of such component, rests upon belt 223, as the latter passes through the guide 235. For purposes of concrete illustration, component 227 is deemed to constitute a multi-lead header of the type previously discussed. These headers are not shown in any great detail, in view of the fact that their construction is conventional and well-known. Such construction is seen, however, to include a body portion 92 provided with an enlarged lip or rim 241. The bottom of the header terminates at a die-receiving face 96. As is well known in this art, the face is surrounded by a plurality of terminal connections or contacts 98. In order to illustrate the invention more clearly, connections 98 have been exaggerated in scale — as have certain other attributes of the header, including the diameter of lip 241 in comparison to that of body 92. In point of fact contacts 98 consist of a conductive terminal which (with the exception to be indicated) is separated from the rest of body 92 by an insulating collar or the like. This type of structure, for example, may be seen at page 5 of the standard handbook "RCA Linear Integrated Circuits" (1970) available from the Solid State Division of RCA, Somerville, N.J. 08876. The several connection contacts are in electrical continuity with a corresponding number of leads, several of which are shown at 281. These leads are again exaggerated in scale for purposes of simplicity. In practice, and as is known in the art, (see e.g. the cited RCA reference) an integrated circuit chip or the like, is intended to ultimately be positioned at die-receiving face 96, with connections being made to the secured chip via the several contacts 98; thereafter the leads 281 enable (in the finished package) macroscopic connections to be made to the packaged chip.

As is common in certain headers of the type considered herein, one of the leads 281, (281*a*), instead of being insulated from body 92, may be electrically continuous therewith. This lead is normally regarded as a "ground" lead, but serves a further function in one aspect of the present invention, as will be discussed in connection with FIG. 4.

Guide 235 includes a pair of longitudinally extending base members 243 and 245; a pair of vertical members 247; a cover piece 301 secured to the tops of members 247 and 248; and a pair of upper flange members 303 and 305, secured to cover piece 301. A pair of channel pieces 253 and 255 are joined to inwardly extending portions of members 243 and 245 by fasteners 257 and 259; although not thus shown, the pieces 253 and 255 may include laterally enlarged unthreaded openings for passage of fasteners 257 and 259, so as to enable a degree of adjustment in the spacing pieces 253 and 255, or other means known in the art may be utilized for this purpose; similarly pieces 253 and 255 may be interchanged with other paired pieces having openings for passage of fasteners 257 and 259 at appropriate positions to yield a desired spacing between pieces 253 and 255. The surfaces 253*a*, 253*b*, 255*a* and 255*b* of pieces 253 and 255, are preferably provided with a tough electrically insulating coating, as of a fluorine-containing thermoplastic such as Kel-F (3M Corp.) or the like. Such coating serves to prevent any possible stray electrical contact with the brush 311 — hereinbelow to be further described. For similar reasons, the fasteners 257 and 259 may preferably comprise an insulator — such as molded nylon.

It is seen that the pieces 253 and 255 cooperate with the inwardly extending portions 260 and 261 of members 243 and 245 to define a longitudinally extended channel 262, through which the belt 223 may pass in its course of progression. It will be further noted that pieces 253 and 255 include shoulder portions 265 and 267, which are in opposition to the lip or rim 241 of the components being conveyed.

It will next be noted (FIG. 1) that an electrical connecting line 329 including a variable resistor 335, terminates at a cable and clamp 269, which enable the positive side 327 of a power supply 325 to be connected to guide 235. The electrical path from the positive side 327 of the said power supply, is a current-shunting path (as will be further discussed below) and is completed to the body of component 227 by contact made between shoulders 265 and 267 and the opposed lip 241 of the component. It will be noted in FIG. 3 that a slight clearance appears to exist between the thus opposed elements. It should be understood, however, that such clearance is shown for purposes of simplification only. In actual practice it will be thus appreciated that as the components are moved through plating station 233, the die-receiving face 96 of component 227 is brought into contact with the adjacent face of solution applicator belt 205. Accordingly, it will be evident that a degree of upward pressure is provided at face 273, and due additionally to the slight flexures and other small displacements as the belt 223 moves, a sliding electrical contact is in fact maintained between lip 241 and shoulders 265 and 267. Since different electrical components may be possessed of slightly differing thicknesses in their lip portions 241, shims may be inserted at the interface between pieces 254, 255 and members 243, 245 — to enable the required accommodation.

It will be evident by considering the FIG. 2 enlarged depiction, that as the components 227 pass through guide 235, they are restrained from wobble about their vertical axis by the closely fitting walls of channel 262 through which they pass. Since, further the entire guide 235 is a rigid structure, die-receiving face 96 (including contacts 98) is very accurately positioned and maintained with respect to the solution-carrying surface 273 of belt 205.

A stationary brush 311 is inserted and secured through a lengthwise-extending opening in cover piece 301, so that the flexible conductive element 120 secured to the brush may contact the leads 281 of component 227 as the component moves through guide 235. The entire brush 311 is electrically insulated from the guide 235, as for example by spacers or by coating any surfaces which could contact the guide with an insulating layer such as the "Kel-F" previously mentioned. Flexible conductive element 120 may take the form of fine brass wire or similar filamentry or other flexible conductive material, which as the components advance, permits the leads 281 to readily engage therewith on a relatively continuous basis, with however the flexible conductive means yielding as the component moves so as not to seriously distort or bend the said leads. Electrical connection to flexible conductive element 120 is made via the conductive support base 283 into which element 120 is embedded or otherwise secured.

In the apparatus set forth in the aforementioned Bick et al application, selective plating of electronic components or the like, including headers 227, has been enabled by applying a cathodic potential to both the header body 92 and to the leads 281, the latter thereby effecting a cathodic potential to each of the isolated electrical contacts 98. The anodic potential enabling the plating circuit was in such prior art approach applied only to an anodic backing electrode, such as the portion of such anode 101 which appears in FIG. 3, i.e. such electrode underlies the moving applicator belt 205. The cathodic potential could in such prior art approach be applied to body 92 through the guide 235, since electrical contact, as already mentioned, is effected to body 92 of shoulders 265 and 267 of the guide.

In one aspect of the present invention, different plating currents are provided to the component body 92 on the one hand, and to the contacts 98 on the other, the object of securing such a differential in the plating currents being to enable a differential in plating thickness between the die-receiving face 96 and the contacts 98. The manner in which this differential in plating current is achieved may be best understood by considering the several Figures herein, and particularly the schematic block diagram of FIG. 4. In the last Figure the component body 92 is shown separated in space from the leads 281 — in order that the circuit for each of the various elements may be better appreciated. The lead 281*a*, which has previously been mentioned as constituting a ground lead, (in the particular type of header now being considered) is also schematically illustrated as electrically connected via a line 331 to component body 91 — again so that the plating circuit through the body 92 may be better appreciated.

Continuing to refer to FIG. 4, it is seen that the negative side 333 of power supply 325 is connected via a lead 317 to the electrically conductive base 283 of brush 311. The flexible conductive element 120 is thus provided with the full cathodic potential, and the various leads 281, as they pass in contact with element 120 receive the said full cathodic potential. As is evident from FIG. 4, the underlying applicator belt 205 passes in contact with the ends of each of leads 281, and in view of the backing electrode 101 thereunder, a circuit is enabled to leads 281 — via an electrode 101 and connection 341, which proceeds back to the positive side 327 of the power supply.

Unlike the prior art it is seen that a connection is now provided between guide 235 and the positive side 327 of power supply 325, via the connecting line 329 (which is in contact with piece 253). This line includes a resistor 335, which preferably is selectively variable in nature. In the arrangement here discussed, the cathodic potential reaches component body 92, not by a direct connection through guide 235, but through the grounded lead 281*a*, and thus by the brush 311.

By virtue of the arrangement just described, the current flowing through the component body 92 may proceed back to positive side 327 of power supply 325 by one of two paths, i.e. firstly by the "normal" path; i.e. through backing electrode 101 and connection 341; or alternatively the current flowing through such body may proceed via a shunted path which includes line 329 with the inserted resistor 335. It will thus be evident that by controlling the value of the variable resistor 335, one may shunt more or less current back to the power supply 325, this current being shunted away from the plating circuit for the body 92. By suitable selection of the value of the cited resistor, one may effectively thus provide any desired degree of differential in plating as between the die-receiving face (schematically suggested at 96 in FIG. 4) on the one hand, and the lead contacts 98 on the other.

The particular significance of the ability to achieve the cited differential in plating thickness, arises by virtue of the finding that lead contacts 98 when provided with a plating thickness of the same value as that on the die-receiving face (as in the prior art), can exhibit marked deterioration upon being subjected to the usual industry tests, including particularly the bake-out tests used in the semi-conductor art. For reasons that are not fully understood, a plating of a particular thickness may thus be acceptable on the relatively extended surfaces of the die-receiving face, and yet be unsatisfactory on the lead contacts. In consequence, it has often been necessary in the prior art to over-plate all portions of the component being treated, in order to assure that the lead contacts would have sufficient material thereon to withstand the mentioned tests. By means of the present arrangement, however, one may secure the desired thickness on the lead contacts as, for example, 50 micro-inches or so forth, while yet placing no more of the precious gold plating than is required upon the die-receiving face.

The power supply 325 is preferably of the constant current type, and is adapted to provide a pulsed output. Devices of this type are commercially available, and the supply 325 preferably includes as well, means for adjusting the ON-OFF ratio of the pulses, and means for adjusting the base current. Background regarding such pulsed output power supplied and pulse plating techniques in general, may be found in an article by A. J. Avila and M. J. Brown, appearing in *Plating* for Nov., 1970 at page 1105.

The ratio of ON to OFF time utilized in the present arrangement can be varied to optimize results. For example, a ratio of 1:10 (ON:OFF), e.g. 0.5 millisec (ON) to 5 Millisec (OFF), appears relatively optimal for general applications where bonding to the platings is to be effected by the so-called aluminum ultrasonic bonding techniques. On the other hand, where thermal compression gold wire bonding is used, ON:OFF ratios of about 1:5, (e.g. 1 ms ON, 5 ms OFF) appear preferable.

In accordance with a further aspect of the present invention, it has been found that at a given plating thickness, superior quality of the plating occurs with the present arrangement — in comparison to the same plating thickness achieved by prior art approach. Such superiority in plating characteristics extends to both the platings on the leads, and those deposited on the die-receiving face. Thus, at a thickness e.g. of the order of 50 micro-inches, it has been found that superior bake-out and other characteristics are observed in platings provided on lead contacts — in comparison to the same plating thickness achieved by the prior art approach, i.e. with the same current used through both the body of the header and through the leads. Analysis appears to indicate that micro-structural differences are indeed present by virtue of the present invention, e.g. in the crystalline structure of the deposited gold.

In a further exemplification of this aspect of the invention, bond strength tests were performed upon the die-receiving faces of components plated to equivalent thicknesses by the prior art techniques, i.e. by utilizing common current levels for both the body and lead portions of the header (as in the cited Bick et al application), and by utilizing the arrangement of the present invention. In a typical instance it was found e.g. that at plating thicknesses of 40 to 59 micro-inches bond strengths averaging 5.19 g were yielded by the prior art approach, while bond strengths averaging 6.08 g were yielded by the method of the invention. In performing these tests power supply 325 was of the pulsed constant current type previously mentioned, and was operated with a pulsing cycle having an ON time of 1 ms and OFF time of 10 ms. The base current for the cycle was zero. Plating peak current was about 25 amps, and the value of resistor 335 was about 17 ohms.

The reasons for the aforementioned improvements are not at the present time fully understood. In the current configuration thus far discussed, it will be noted that all plating current proceeds through the brush 311. By virtue of such brush, it will be appreciated that the said current, i.e. that proceeding through line 333 (which is pulsed to begin with) is in turn interrupted at a relatively high frequency — in that the contacts between flexible conductor element 120 (of wire or so forth) and leads 281, are in fact intermittent.

A further "pulsing" action is effectively thereby superimposed onto the plating circuit; and it is possible that this further pulsing may be a factor involved in the superior gold deposits achieved. This hypothesis appears in the present instance to be further supported by the finding that the resistor 335 can effectively be reduced to zero, i.e. can constitute a complete short; and yet satisfactory results are yielded for the plating deposits at contacts 98. With such a direct short present, the constant current supply can, of course, yet function effectively — since the potential of such source will simply drop to zero each time a circuit is completed through the short, i.e. through the intermittent contact via brush 120 and lead 281*a.* Of course, where such a short is present, it will be evident that virtually all the electroplating is effected upon contacts 98, with the plating upon the die-receiving face being limited to that secured by the immersion potential.

It has previously been mentioned that not all headers of the type considered herein include a "ground" lead such as lead 281*a.* In these other instances all leads are insulated from body 92. The equivalent circuit present where these latter type of headers are treated is identical to that thus far discussed in connection with FIG. 3, except that a direct connection is provided between the negative side of supply 325 and guide 235 — as indicated by the dotted connection 342, this being necessary since the "ground lead" connection 331 is not present with these latter headers. That additional factors are involved in the unexpected results yielded by the invention is supported by the further finding that even where the invention is employed to treat these further headers, the same sort of improvements in plating quality is found upon both contacts and die-receiving face.

While the present invention has been particularly described in terms of specific embodiments thereof, it will be understood in view of the instant disclosure, that numerous variations upon the invention are now enabled to those skilled in the art, which variations here reside within the scope of the teaching. Accordingly, the invention is to be broadly construed and limited only by the scope and spirit of the claims now appended hereto.

I claim:

1. Apparatus for continuous electroplating of at least first and second mutually insulated selected portions of an electronic component or the like, while effecting differential plating thicknesses upon said portions, said apparatus comprising:

an electroplating station;

moveable applicator means adapted for carrying electroplating solution on a surface thereof;

means for continuously moving at least a portion of said applicator means surface through said electroplating station;

means for applying electroplating solution to said applicator surface;

means for moving said components through said electroplating station with said portions to be electroplated in contact with said applicator surface;

a source of electrical plating potential;

means connecting the negative side of said potential source to each of said mutually insulated portions of said components during movement of said components through said electroplating station;

anodic means underlying said applicator surface at said electroplating station, and connected in a circuit with the positive side of said potential source in order to effect a plating current;

a shunt path means connected between one of said component portions and the positive side of said potential source, for shunting at least a portion of the current to said one portion, back to said potential source, whereby to effect differential plating between said first and second portions of said component in accordance with the current proportioning effected by said shunt path;

the components to be plated in said apparatus being of the type comprising an electrically conductive body terminating in a die-receiving face, and including a plurality of electrical contacts formed as insulated islands at said die-receiving face, with flexible wire leads being connected to at least some of said contacts and extending oppositely from said die-receiving face beyond the body of said component, at least some of said leads being electrically insulated from said body; said selective portions to be electroplated being said die-receiving face, and said electrical contacts; and wherein said apparatus includes electrically conductive guide means for guiding said components through said electroplating station with the said component body in electrical contact with said guide, and with said die-receiving face and said contacts in contact with the said applicator surface; the said means connecting the negative side of said potential source to at least said leads comprising an electrically conductive brush mounted at said electroplating station; and said shunt path being provided by a connection between said guide means and the positive side of said potential source.

2. Apparatus in accordance with claim 1, wherein said shunt path comprises a resistive path connected between the positive side of said power source and said one portion of said component.

3. Apparatus in accordance with claim 2, wherein said resistive path includes a selectively variable resistor, whereby the differential plating between said component portions may be selectively varied according to the setting of said resistor.

4. Apparatus in accordance with claim 1, wherein said potential source is a constant current-type pulsed voltage supply.

5. Apparatus in accordance with claim 4, wherein said means connecting the negative side of said source to said component portions includes a brush means effecting intermittent electrical connections to at least one of said portions.

6. Apparatus in accordance with claim 1, wherein said components include at least one of said leads in electrical contact with said body of said component, whereby the negative side of said potential source is further connected to said body through said brush.

* * * * *